US010062997B2

(12) United States Patent
Wang et al.

(10) Patent No.: US 10,062,997 B2
(45) Date of Patent: Aug. 28, 2018

(54) ELECTRICAL CONNECTOR HAVING IMPROVED CONTACTS

(71) Applicant: FOXCONN INTERCONNECT TECHNOLOGY LIMITED, Grand Cayman (KY)

(72) Inventors: Tao Wang, Kunshan (CN); Zhen-Sheng Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/240,165

(22) Filed: Aug. 18, 2016

(65) Prior Publication Data

US 2017/0054242 A1 Feb. 23, 2017

(30) Foreign Application Priority Data

Aug. 18, 2015 (CN) ..... 2015 2 0618728 U

(51) Int. Cl.

| | |
|---|---|
| ***H01R 13/24*** | (2006.01) |
| ***H01R 13/405*** | (2006.01) |
| ***H01R 12/71*** | (2011.01) |
| ***H01R 4/02*** | (2006.01) |

(52) U.S. Cl.

CPC ..... *H01R 13/405* (2013.01); *H01R 4/02* (2013.01); *H01R 12/714* (2013.01); *H01R 13/2442* (2013.01)

(58) Field of Classification Search

CPC .... H01R 13/24; H01R 13/405; H01R 13/447; H01R 13/2464; H01R 12/714; H01R 12/716

USPC ..... 439/66, 862

See application file for complete search history.

(56) References Cited

U.S. PATENT DOCUMENTS

| | | | | |
|---|---|---|---|---|
| 6,520,785 | B2 * | 2/2003 | Hida | H01R 24/46 200/51.09 |
| 6,663,439 | B2 * | 12/2003 | Henry | H01R 13/2421 439/700 |
| 6,814,626 | B2 * | 11/2004 | Wen-Yao | H01R 13/2421 439/515 |
| 7,134,878 | B2 * | 11/2006 | Zheng | H01R 13/2421 439/515 |
| 7,901,216 | B2 | 3/2011 | Rohrbach et al. | |
| 8,277,230 | B2 * | 10/2012 | Huo | H01R 12/716 439/342 |
| 8,491,338 | B1 * | 7/2013 | Lin | H01R 13/2421 439/500 |

(Continued)

*Primary Examiner* — Edwin A. Leon
*Assistant Examiner* — Oscar Jimenez
(74) *Attorney, Agent, or Firm* — Wei Te Chung; Ming Chieh Chang

(57) ABSTRACT

An electrical connector includes an insulative housing and a number of contacts over-molded in the insulative housing, each of the contacts including: a conductive member comprising a base portion and a contact portion projected from the base portion and exposed out of the insulative housing for being electrically connected with a mating connector contact; and a connecting member electrically connected with the conductive member. The connecting member includes a soldering portion soldered with the base portion, an elastic portion for connecting to a printed circuit board, and a connecting portion connected between the soldering portion and the elastic portion.

20 Claims, 5 Drawing Sheets

(56) References Cited

U.S. PATENT DOCUMENTS

| | | | | |
|---|---|---|---|---|
| 9,362,687 | B1 * | 6/2016 | Ju | H01R 13/665 |
| 2005/0070130 | A1 * | 3/2005 | Zheng | H01R 12/88 439/62 |
| 2005/0070171 | A1 * | 3/2005 | Zheng | H01R 13/2421 439/700 |
| 2010/0248504 | A1 * | 9/2010 | Yeh | H01R 13/24 439/74 |
| 2012/0236479 | A1 * | 9/2012 | Tamai | B62D 5/0406 361/679.01 |
| 2013/0035006 | A1 * | 2/2013 | Park | H01R 12/714 439/862 |
| 2014/0377986 | A1 * | 12/2014 | Endo | H01R 13/2421 439/519 |
| 2015/0126077 | A1 | 5/2015 | van Ekstrom | |
| 2015/0288422 | A1 | 10/2015 | Fishman et al. | |
| 2015/0311619 | A1 * | 10/2015 | Kato | H01R 13/6594 439/137 |
| 2015/0349457 | A1 | 12/2015 | Shariff et al. | |

* cited by examiner

ELECTRICAL CONNECTOR HAVING IMPROVED CONTACTS

BACKGROUND OF THE INVENTION

1. Field of the Invention

The present invention relates to an electrical connector, and more particularly to contacts structure of the electrical connector.

2. Description of Related Arts

U.S. Pat. No. 7,901,216, issued on Mar. 8, 2011, discloses an electrical connector adapted for connecting a plug connector to a printed circuit board. The electrical connector comprises a body, a plurality of contacts, and a shell enclosing the body. The electrical connector is soldered to the printed circuit board through pins. The contacts are substantially flat plates electrically connected to the pins by wires.

U.S. Patent Application Publication No. 20150349457, published on Dec. 3, 2015, shows a port including a metal frame surrounding a well, a plurality of contact pads disposed within the well, and an insulative frame for isolating the contact pads.

SUMMARY OF THE INVENTION

An object of the present invention is to provide an electrical connector having an improved contact structure that is electrically connected to a printed circuit board reliably.

To achieve the above-mentioned object, an electrical connector comprises: an insulative housing; and a plurality of contacts being over molded in the insulative housing, each of the contacts comprising:

a conductive member comprising a base portion and a contact portion projected from the base portion and exposed out of the insulative housing for being electrically connected with a mating connector contact; and a connecting member electrically connected with the conductive member, the connecting member including a soldering portion soldered with the base portion, an elastic portion for connecting to a printed circuit board, and a connecting portion connected between the soldering portion and the elastic portion.

DETAILED DESCRIPTION OF THE PREFERRED EMBODIMENT

Figure 1:
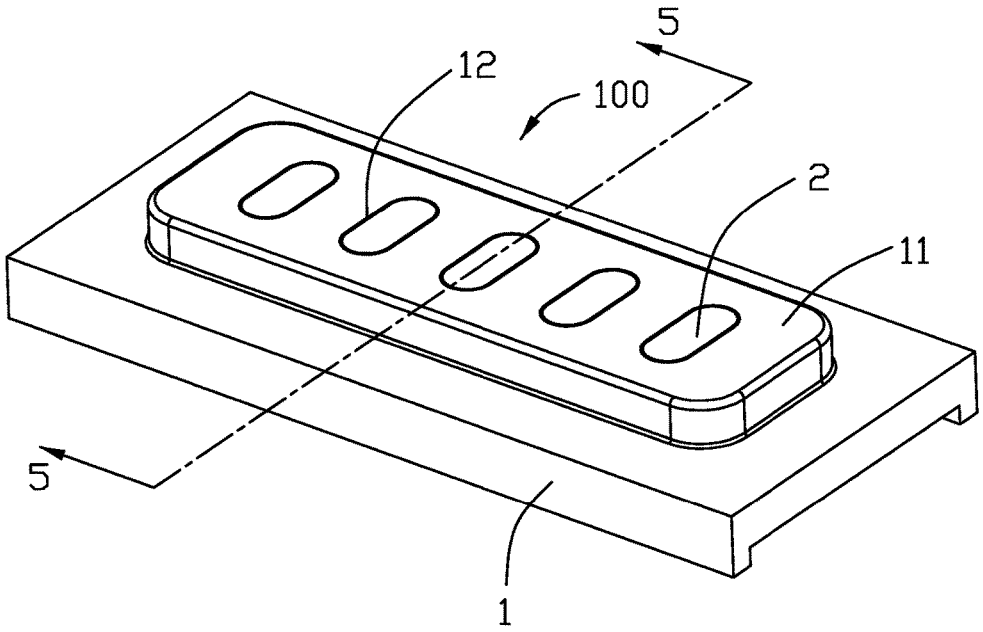
FIG. 1 is a perspective view of an electrical connector in accordance with the present invention.
Figure 2:
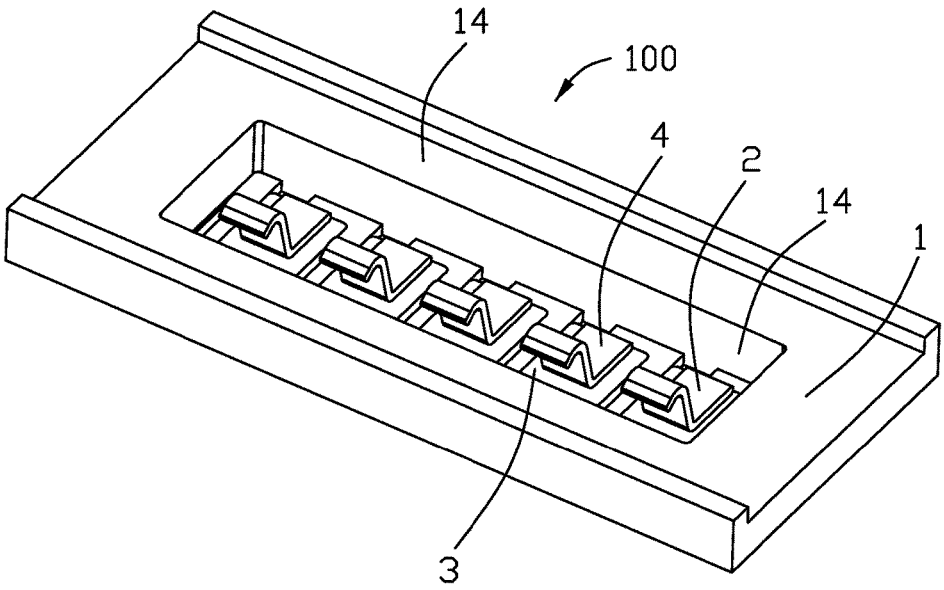
FIG. 2 is another perspective view of an electrical connector as shown in FIG. 1.
Figure 3:
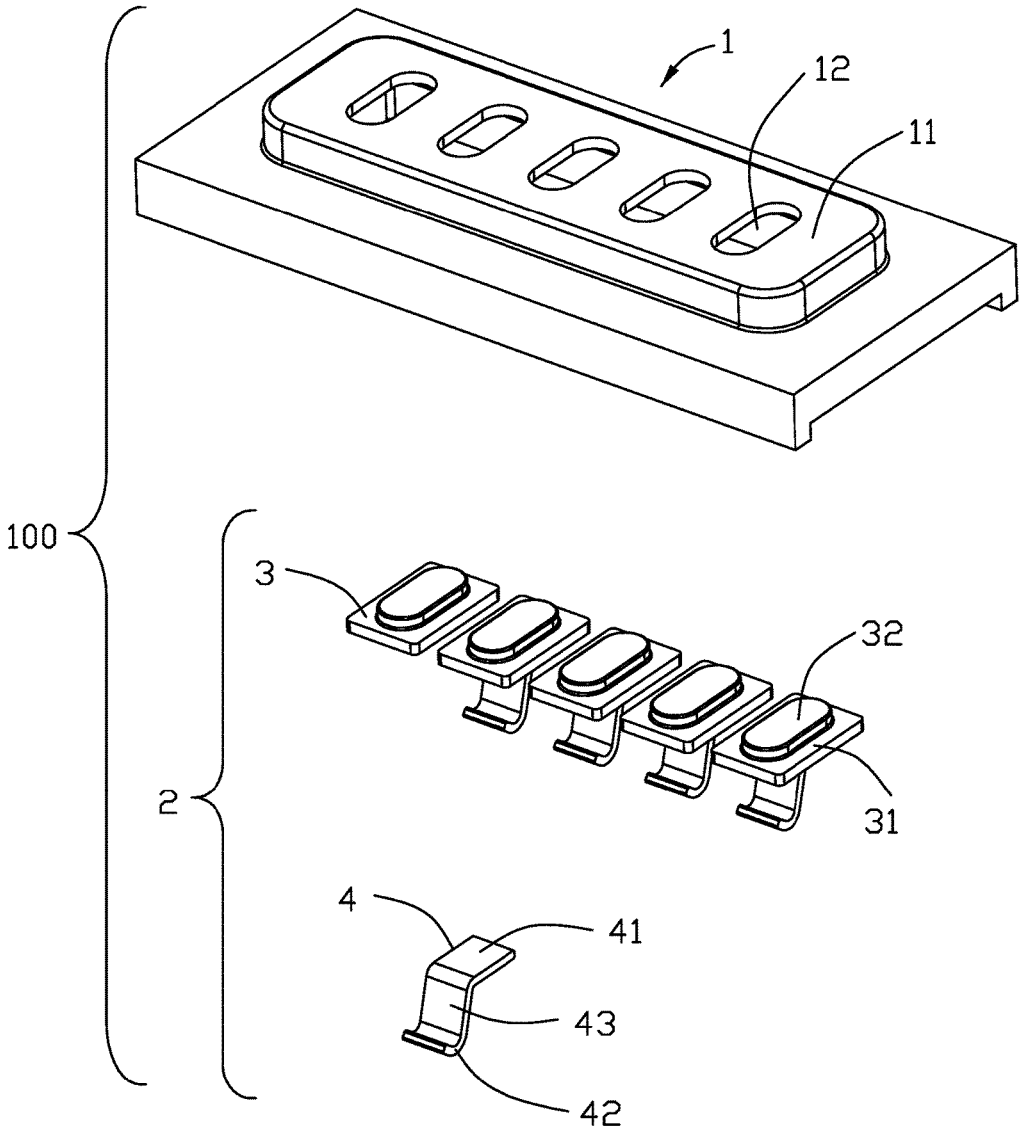
FIG. 3 is a partly exploded view of the electrical connector as shown in FIG. 1.
Figure 4:
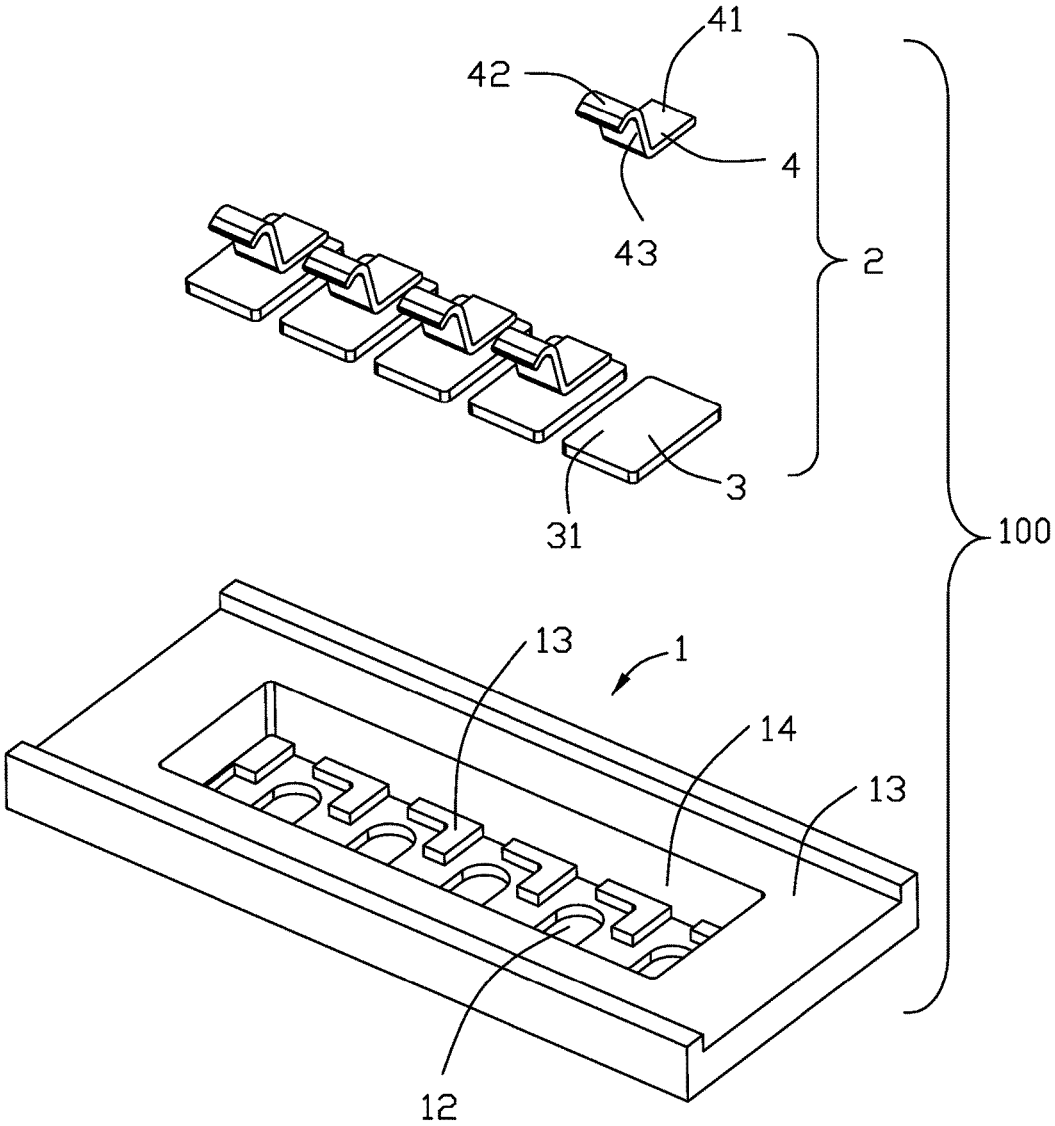
FIG. 4 is another partly exploded view of the electrical connector as shown in FIG. 3.

Reference will now be made in detail to a preferred embodiment of the present invention.

Referring to FIGS. 1 to 5, an electrical connector 100 is adapted for electrically connecting a mating connector to a printed circuit board to transmit signal, power, or signal and power. The electrical connector comprises an insulative housing 1 and a plurality of contacts 2 being over molded in the insulative housing 1. Each of the contacts 2 comprises a conductive member 3 molded in a fixed manner to the insulative housing 1, and a connecting member 4 electrically connected with the conductive member 3 and adapted for being pressed against with the printed circuit board to establish an electrical connection therewith.

The insulative housing 1 has a rectangular shape. The insulative housing 1 comprises a main body, a receiving portion 11 projected from the main body. The first the receiving portion 11 has a diameter smaller than a diameter of the main body. The contacts 2 are molded in the receiving portion 11. The receiving portion 11 is formed a plurality through holes 12 for receiving the contacts 2 when the insulative housing is molded in the contacts 2. Each of the holes 12 has a rectangular shape in a middle portion and a half circle shape in two opposite ends of the middle portion. The insulative housing 1 defines a first recess 13 recessed from a bottom surface of the main body toward the receiving portion 11 for receiving the printed circuit board. The first recess 13 extends through the main body along a length direction. The insulative housing 1 defines a second recess 14 further recessed form the first recess 13 toward the receiving portion 11. Each of the holes 12 comprises a stepped portion 15 adjacent to the second recess that is suitable a shape of the contacts 2.

Figure 5:
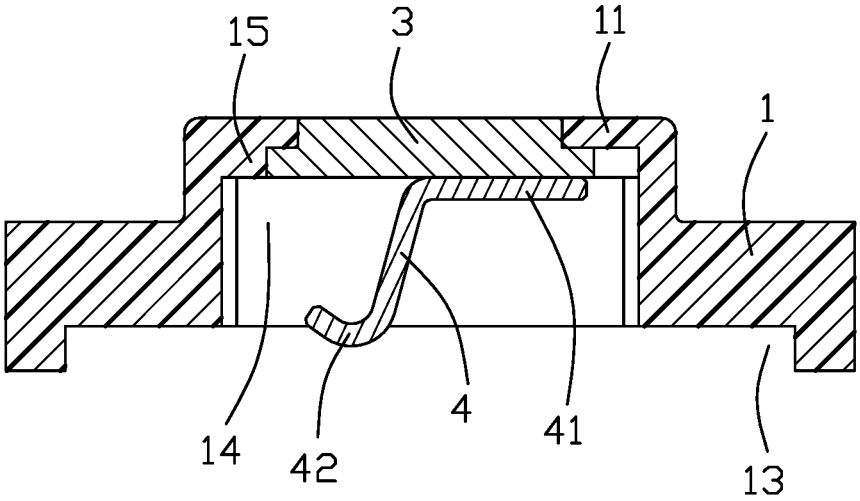
FIG. 5 is cross sectional view of the electrical connector taken along line 5-5 in FIG. 1.

Each of the conductive members 3 comprises a base portion 31 having a flat shape, and a contact portion 32 smaller than the base portion 31 in a top view and upwardly projecting from the base portion 31 to be exposed upwardly out the insulative housing 1 for being electrically connected with the mating connector. Notably, because the contact 2 is molded in the receiving portion 11 as illustrated before, the contact portion 32 is peripherally snugly embedded within the corresponding hole 12 as shown in FIG. 5. All of the contact portions 32 are disposed at a common plane. The contact portion 32 has a rectangular shape in a middle portion and a half circle shape in two opposite ends of the middle portion.

Each of the connecting member 4 comprises a soldering portion 41 having a flat shape soldered with the base portion 31, an elastic portion 42 for being elastic contacted with and electrically connected with the printed circuit board, and a connecting portion 43 connected between the soldering portion 41 and the elastic portion 42. The soldering portion 41 is parallel to the base portion 31. The connecting portion 43 extends inclined between the soldering portion 41 and the elastic portion 42. The elastic portion 42 has an arced shape. The connecting members member 4 is received in the second recess 14, with a portion of the elastic portion 42 extending into the first recess 13 for being electrically connected with the printed circuit board. The second recess 14 is fully filled with glue to improve waterproof performance. The connecting members 4 are soldered with the conductive members 3 before or after the insulative housing 2 is over molded with the conductive members 3. The connecting member 4 is separate from the insulative housing 2, i.e., not joined or touching physically.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising: an insulative housing; and a plurality of contacts being over molded in the insulative housing, each of the contacts comprising: a conductive member being fixedly molded to the insulative housing and comprising a base portion and a contact portion projected from the base portion and exposed out of the insulative housing for being electrically connected with a mating connector contact; and a connecting member electrically connected with the conductive member, the connecting member including a soldering portion soldered with the base portion, an elastic portion for connecting to a printed circuit board, and a connecting portion connected between the soldering portion and the elastic portion, the connecting member being separate from the insulative housing and is deflectable in the vertical direction.

2. The electrical connector as recited in claim 1, wherein the connecting portion extends inclinedly between the soldering portion and the elastic portion.

3. The electrical connector as recited in claim 1, wherein the base portion is flat, and the soldering portion is flat and parallel to the base portion.

4. The electrical connector as recited in claim 3, wherein the elastic portion is arcuate.

5. The electrical connector as recited in claim 1, wherein the insulative housing comprises a main body and a receiving portion projected from the main body, and the contacts are molded in the receiving portion.

6. The electrical connector as recited in claim 5, wherein the insulative housing defines a first recess recessed from a bottom surface of the main body toward the receiving portion.

7. The electrical connector as recited in claim 6, wherein the insulative housing defines a second recess further recessed form the first recess toward the receiving portion, the connecting members are received in the second recess, and a portion of the elastic portion extends into the first recess.

8. The electrical connector as recited in claim 7, wherein the second recess is filled with glue.

9. The electrical connector as recited in claim 5, wherein the receiving portion has a diameter smaller than a diameter of the main body.

10. The electrical connector as recited in claim 6, wherein the first recess extends through the main body along a lengthwise direction.

11. The electrical connector as recited in claim 1, wherein the contact portions are disposed at a common plane.

12. An electrical connector comprising: an insulative housing defining an upper mating face and a lower mounting face opposite to each other in a vertical direction; and a plurality of contacts being over molded in the insulative housing, each of the contacts including: a conductive member received within and fixed to the housing and forming a contact portion exposed upon the upper mating face for being electrically connected with a mating connector contact; and a connecting member discrete from the conductive member and soldered to the conductive member, the connecting member including an elastic portion with a curved end extending around the lower mounting face for connecting to a printed circuit board, the connecting member being separate from the insulative housing; wherein said conductive member is rigid while said connecting member is deflectable in the vertical direction.

13. The electrical connector as claimed in claim 12, wherein said connecting member is soldered on an underside of the conductive member.

14. The electrical connector as claimed in claim 12, wherein said conductive member includes a base portion and said contact portion protrudes upwardly from the base portion, said base portion being larger than the contact portion in a top view so as to prohibit said conductive member from being upwardly withdrawn from the housing.

15. The electrical connector as claimed in claim 14, wherein said connecting member is soldered upon an underside of the base portion.

16. An electrical connector comprising: an insulative housing defining an upper mating face and a lower mounting face opposite to each other in a vertical direction; and a plurality of contacts being over molded in the insulative housing, each of the contacts including: a conductive member received within and fixed to the housing and forming a contact portion exposed upon the upper mating face for being electrically connected with a mating connector contact; and a connecting member discrete from the conductive member and soldered to the conductive member, the connecting member including an elastic portion with a curved end extending around the lower mounting face for connecting to a printed circuit board; wherein said conductive member is rigid while said connecting member is deflectable in the vertical direction; wherein each of said contacts includes a base portion and the contact portion is smaller than the base portion in a top view and is peripherally snugly received in a corresponding hole in the housing for waterproofing.

17. The electrical connector as claimed in claim 16, wherein said housing defines a first recess around a bottom end for receiving said printed circuit board.

18. The electrical connector as claimed in claim 17, wherein said housing further forms a second recess located above the first recess, and the connecting members is located in the second recess.

19. The electrical connector as claimed in claim 18, wherein the second recess is filled with glue for waterproofing.

20. The electrical connector as claimed in claim 16, wherein each hole forms a stepped portion in compliance with the base portion and the contact portion of the corresponding conductive member.

* * * * *